US007232184B2

(12) United States Patent
Lawler

(10) Patent No.: US 7,232,184 B2
(45) Date of Patent: Jun. 19, 2007

(54) SEAT SOCK

(76) Inventor: Suzanne Lawler, 423 Amesbury Pl., Glassboro, NJ (US) 08028

( * ) Notice: Subject to any disclaimer, the term of this patent is extended or adjusted under 35 U.S.C. 154(b) by 0 days.

(21) Appl. No.: 11/178,995

(22) Filed: Jul. 11, 2005

(65) Prior Publication Data

US 2007/0007803 A1 Jan. 11, 2007

(51) Int. Cl.
*A47C 31/11* (2006.01)

(52) U.S. Cl. ..... 297/228.1; 297/219.1; 297/220; 297/228.12

(58) Field of Classification Search ..... 297/228.1, 297/228.12, 219.1, 220
See application file for complete search history.

(56) References Cited

U.S. PATENT DOCUMENTS 5,275,463 A * 1/1994 Rocha ..... 297/228.12 X
5,441,789 A * 8/1995 Walker ..... 297/228.12 X
5,655,813 A * 8/1997 Kirkpatrick ..... 297/220
5,785,381 A * 7/1998 Carter ..... 297/219.1
5,806,925 A * 9/1998 Hanley ..... 297/228.1 X
6,634,709 B1 * 10/2003 Hetherington ..... 297/228.12 X
6,648,410 B2 * 11/2003 Sparks ..... 297/228.12
6,709,055 B2 * 3/2004 Gengler et al. ..... 297/228.12 X
6,948,771 B1 * 9/2005 Salandy ..... 297/220 X
6,951,367 B1 * 10/2005 Dinnan ..... 297/228.12
7,000,984 B1 * 2/2006 Ward ..... 297/228.12
2003/0015899 A1 * 1/2003 Clay ..... 297/219.1
2006/0076810 A1 * 4/2006 Nichols ..... 297/220

* cited by examiner

*Primary Examiner*—Rodney B. White
(74) *Attorney, Agent, or Firm*—Frank A. Lukasik

(57) ABSTRACT

The seat sock is a protective covering to slip over the back of a movie/theater seat to act as a personal barrier between the user and the surface of the seat back. The seat sock consists of a piece of stretchable polyester fabric which is folded over and stitched along the thirty two inch length, folded inside out and stitched along a twenty two inch length. The cylinder is then folded right side out. An elastic loop is attached, stretched and slipped around the rolled seat sock.

1 Claim, 7 Drawing Sheets

Fold
10
32 inches 23 inches 11
one inch
seam
32 inches
10

Fold inside out till
raw edges meet.
11
32 inches 10
10
16 inches
one inch zig-zag seam
11
22 inches 10
15 inches
Turn
right-
side
out.

8 inches
attach loop of folded 1/4 inch
elastic
12

10
22 inches
Finished
"SEAT SOCK"
15 inches

12

Remove and

Flatten

Fold vertically twice (FIG. 9A & FIG. 9B)

To Use - unroll and pull over seat back

SEAT SOCK

BACKGROUND OF THE INVENTION

1. Field of the Invention

The present invention relates generally to covers and more specifically to a protective covering to slip over the back of a movie/theater seat to act as a personal barrier between the user and the surface of the seat back 2. Description of the Prior Art There were no prior art devices found to be used as protective covering for movie theater seats. The only prior art devices found related to automobile seat covers.

BRIEF SUMMARY OF THE INVENTION

The seat sock is a protective covering to slip over the back of a movie/theater seat to act as a personal barrier between the user and the surface of the seat back. The seat sock endeavors to give a level of comfort and piece of mind for those uncomfortable resting their heads against the back of a movie/theater seat which has been used by multiple persons. The seat sock is constructed from a piece of stretchable polyester fabric folded over and stitched to form a compartment to fit over the movie/theater seat top.

DETAILED DESCRIPTION OF THE INVENTION

Figure 1:
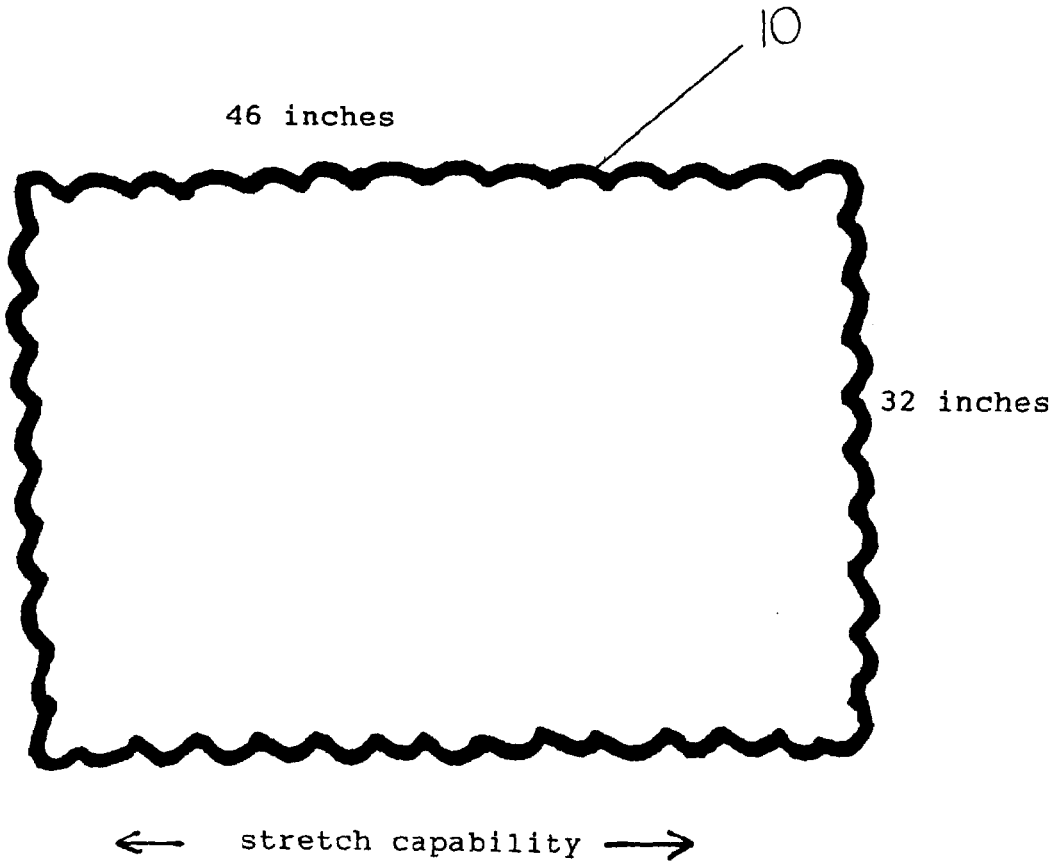
FIG. 1 is a front view of a piece of stretchable polyester fabric.
Figure 2:
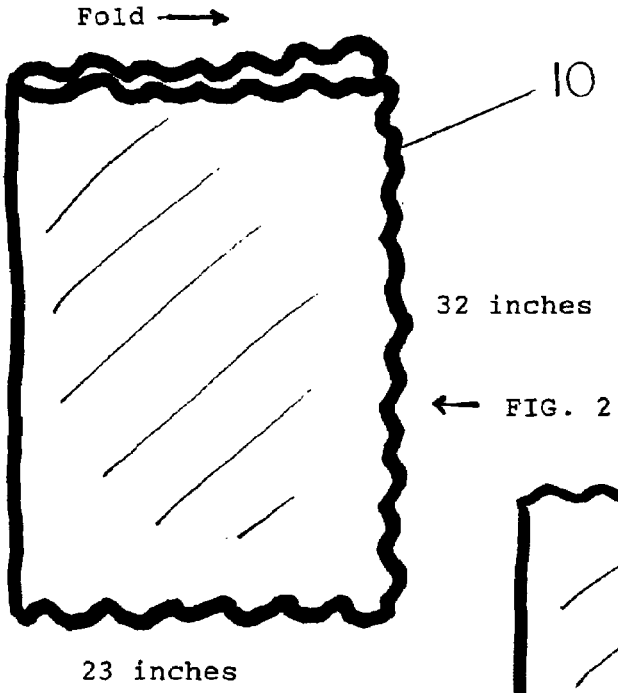
FIG. 2 shows the fabric folded over.
Figure 3:
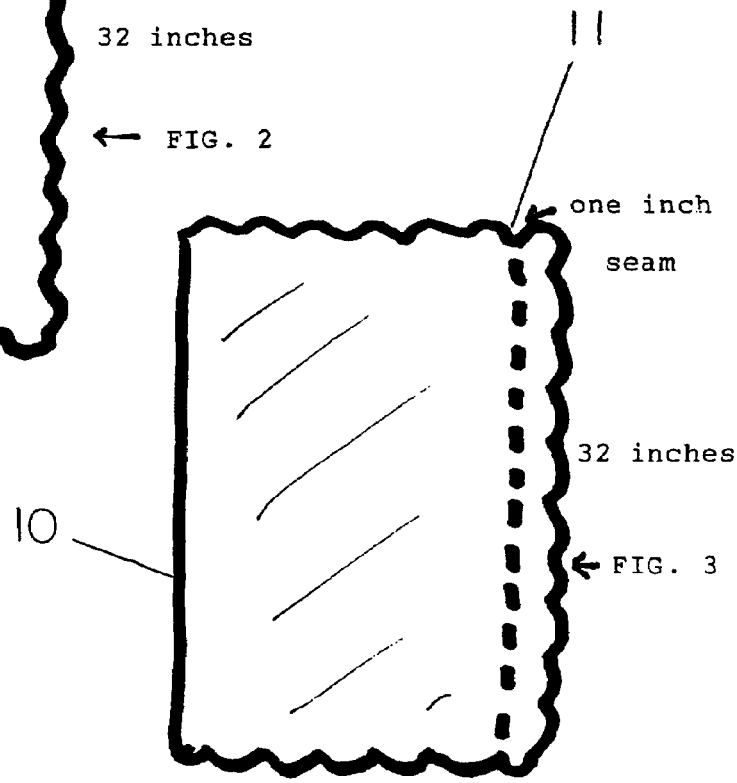
FIG. 3 shows a straight stitch seam.

The seat sock of the invention is designated generally by the numeral 10. The seat sock is constructed from a piece of stretchable polyester fabric folded over and stitched to form a compartment to fit over the movie/theater seat top. Cut a piece of stretchable polyester fabric 32 inches by 46 inches with the stretch capability on the 46 inch length as shown in FIG. 1. As shown in FIG. 3, fold the material so that the 32 inch sides line up (FIG. 2) and straight stitch a one inch seam 11 down the 32 inch length thereby forming a cylinder of Fabric.

Figures 4, 5:
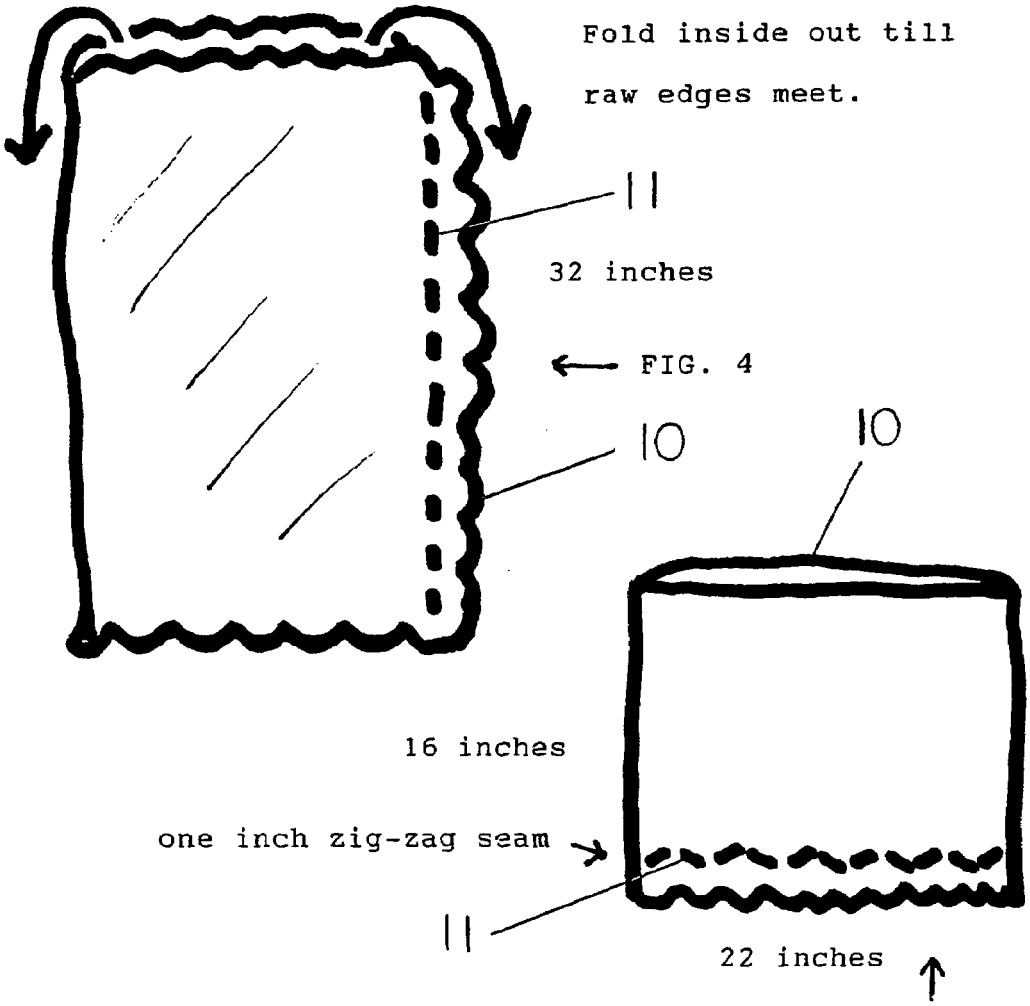
FIG. 4 shows the cylinder folded over.
FIG. 5 shows a zig-zag stitch seam.

As shown in FIG. 4, fold the inside of the cylinder out and over until the two raw edges meet. As shown in FIG. 5, run a zig-zag seam 11 across the 22 inch raw edge using a one inch seam allowance.

Figure 6:
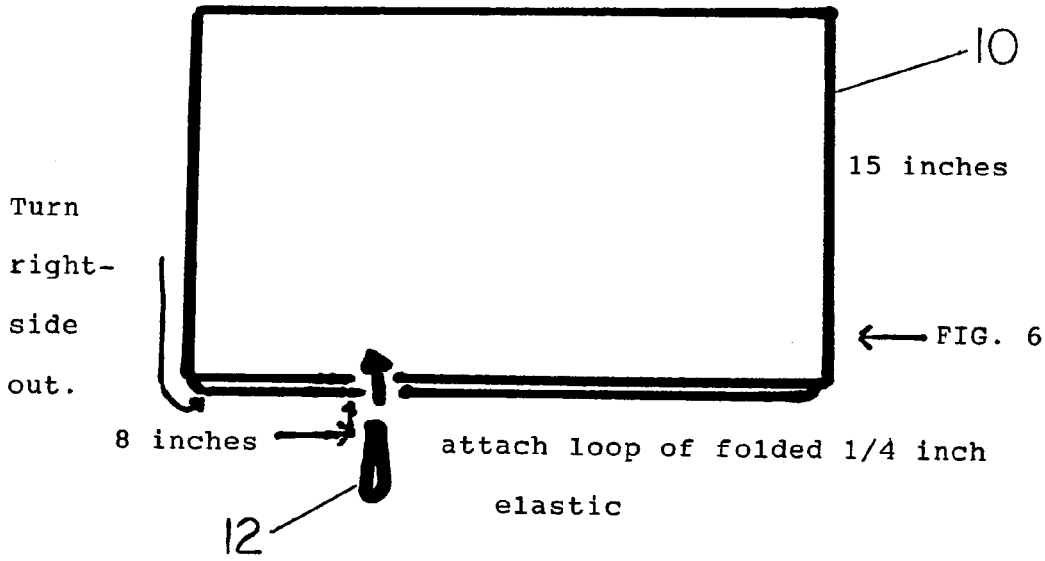
FIG. 6 shows the invention right side out.
Figure 7:
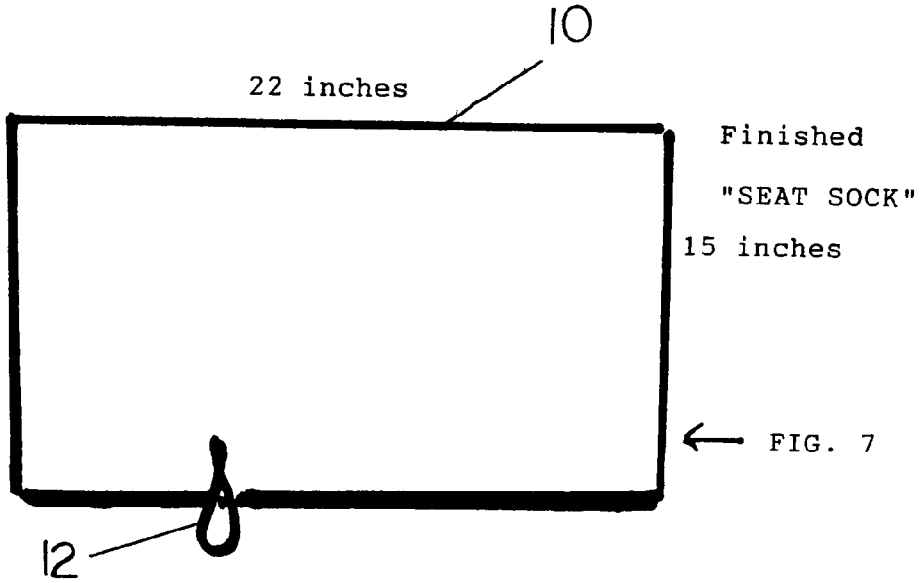
FIG. 7 shows the finished invention.

As shown in FIG. 5 the seat sock 10 is then turned right-side out. An eight inch length of one quarter inch elastic is folded in half to form a loop 12 and is attached by sewing to the open end of the seat sock 10, eight inches from the side seam (FIGS. 6 and 7). The finished seat sock 10 measures 22 inches wide and 15 inches long (FIG. 7).

Figure 11:
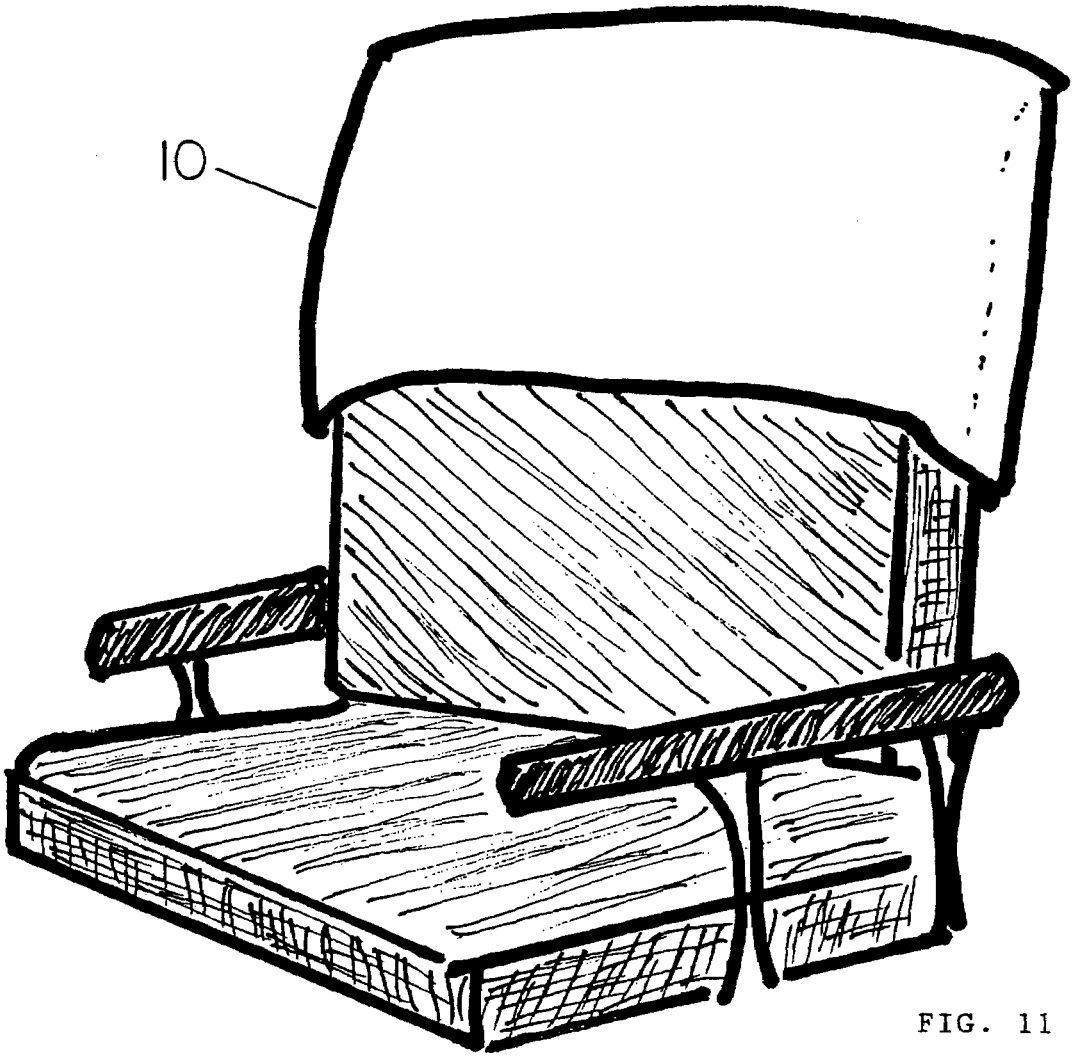
FIG. 11 shows a seat sock mounted on a movie/theater seat.

In actual use, the seat sock 10 is pulled over the back of a movie/theater seat (FIG. 11).

Figure 8:
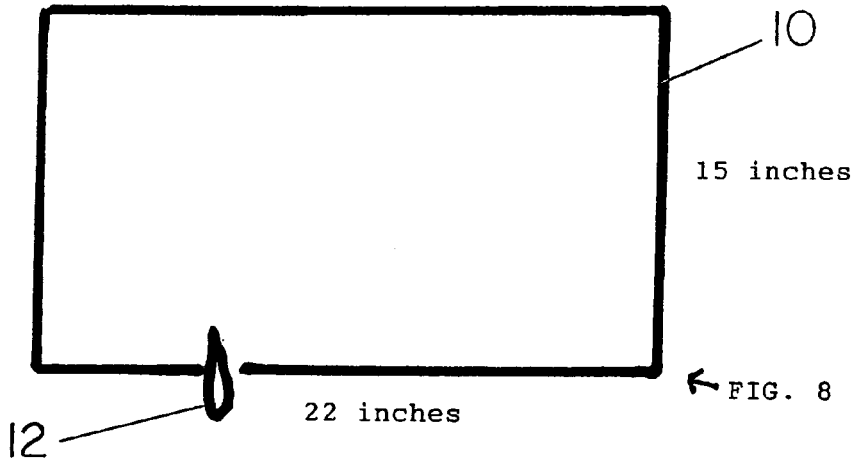
FIG. 8 shows a flattened seat sock.
Figure 9A:
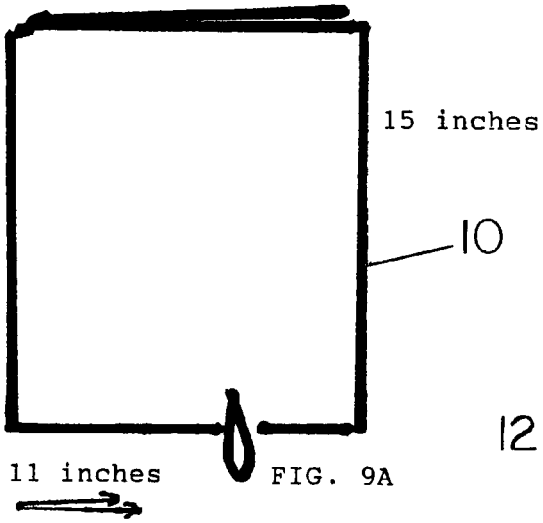
FIGS. 9A and 9B show a first and second fold.
Figure 9B:
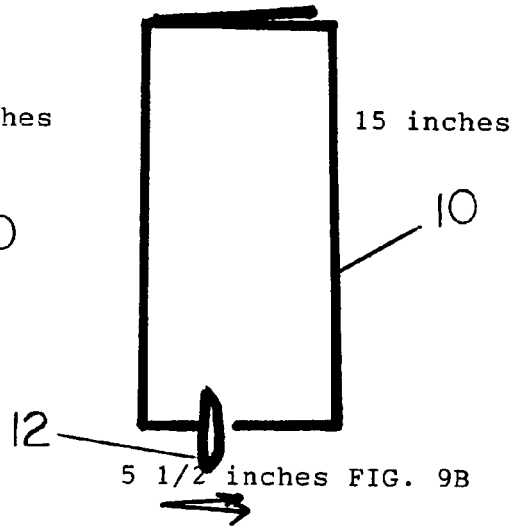
Figure 10A:
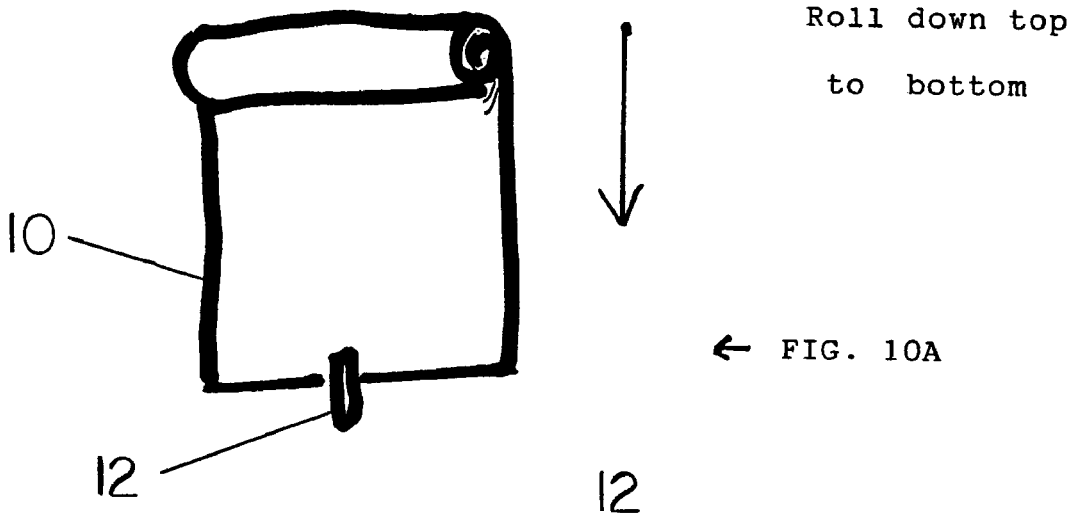
FIGS. 10A and 10B show a rolled seat sock and an elastic loop.
Figure 10B:
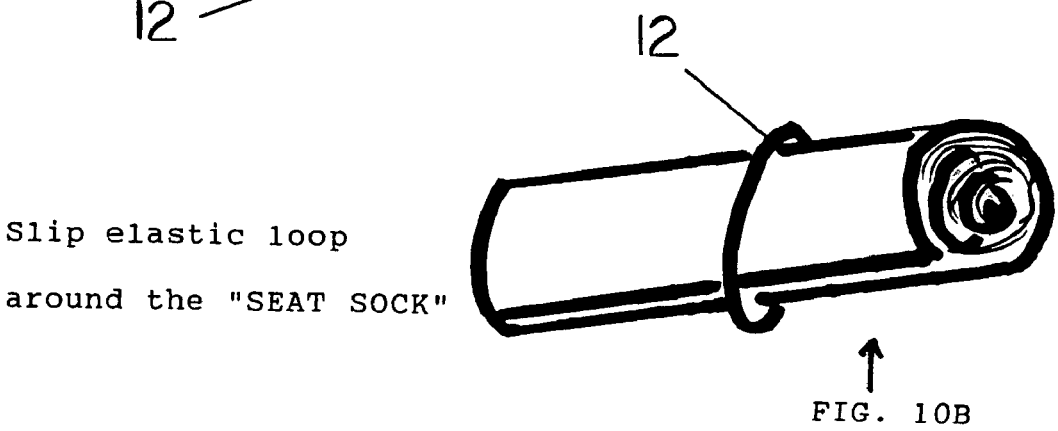

When usage is completed, the seat sock 10 is removed from the movie/theater seat and flattened as shown in FIG. 8. The seat sock 10 is then folded in half, vertically, twice as shown in FIGS. 9A and 9B. The seat sock 10 is then rolled down from the top to bottom (FIG. 10). The elastic loop 12 is stretched and slipped around the rolled seat sock 11 (FIG. 10 B).

As shown in FIG. 11, the seat sock 10 is unrolled and pulled over the movie/theater seat back. The seat sock 10 is machine washable.

I claim:

1. A protective cover for slipping over the back of a movie/theater seat to act as a personal barrier between the user and the surface of the seat back, said cover comprising:

a substantially rectangular piece of stretchable polyester fabric, said piece of fabric having a pair of opposite thirty-two inch sides and a pair of opposite forty-six inch sides, said piece of fabric stretchable lengthwise along the forty-six inch length of the fabric, said material being folded over and having said thirty-two inch sides straight stitched together using a one inch seam allowance, thereby forming a cylinder of fabric, said cylinder being folded inside out and over until said thirty-two inch sides touch each other, thereby forming a sixteen inch length, and a twenty-two inch width, said twenty-two inch width being joined together by running a zig-zag seam using a one inch seam allowance and said cylinder being folded right side out, and a folded eight inch length being folded in half and attached to said protective cover.

* * * * *